US006059078A

United States Patent [19]

Nykoluk

[11] Patent Number: 6,059,078

[45] Date of Patent: May 9, 2000

[54] EXPANDABLE BAG WITH STIFFENING MEMBER

[75] Inventor: Cory O. Nykoluk, San Jose, Calif.

[73] Assignee: Mainland Marketing, Inc., Half Moon Bay, Calif.

[21] Appl. No.: 09/066,644

[22] Filed: Apr. 24, 1998

[51] Int. Cl.[7] ..... A45C 5/14; A45C 7/00; A45C 13/04

[52] U.S. Cl. ..... 190/103; 190/18 A; 190/107; 190/127

[58] Field of Search ..... 190/103–105, 190/107, 122, 127, 903, 18 A; 383/97

[56] References Cited

U.S. PATENT DOCUMENTS

| | | | |
|---|---|---|---|
| 672,143 | 4/1901 | Boughner | 190/104 |
| 1,513,909 | 11/1924 | Hunter | 190/103 |
| 2,405,361 | 8/1946 | Langford et al. | 190/127 X |
| 2,496,128 | 1/1950 | Lifton . | |
| 2,710,084 | 6/1955 | Braverman | 190/127 X |
| 2,716,473 | 8/1955 | Droutman | 190/127 X |
| 2,718,943 | 9/1955 | Braverman | 190/107 |
| 3,443,671 | 5/1969 | Dyke | 383/97 X |
| 3,447,648 | 6/1969 | Schwennicke | 190/103 |
| 3,504,772 | 4/1970 | Barry | 190/105 |
| 4,160,496 | 7/1979 | Knight | 190/107 |
| 4,588,056 | 5/1986 | Bernbaum | 190/107 |
| 4,953,673 | 9/1990 | Ambaz | 190/103 |
| 5,103,945 | 4/1992 | Kaneko | 190/107 |
| 5,197,580 | 3/1993 | Berman et al. | 190/107 |
| 5,251,731 | 10/1993 | Cassese et al. | 190/107 |
| 5,671,831 | 9/1997 | Chiu | 190/103 |
| 5,749,446 | 5/1998 | Hsieh | 190/103 X |
| 5,819,891 | 10/1998 | Wang et al. | 190/103 |

FOREIGN PATENT DOCUMENTS

| | | | |
|---|---|---|---|
| 2233010 | 1/1975 | France | 190/104 |
| 2184940 | 7/1987 | United Kingdom | 190/107 |

*Primary Examiner*—Sue A. Weaver
*Attorney, Agent, or Firm*—Flehr Hohbach Test Albritton & Herbert LLP

[57] ABSTRACT

An expandable bag movable between a contracted position and an expanded position. The expandable bag comprises a body enclosing a space. The body has top and bottom walls, front and rear walls and left and right walls. A handle is mounted on the body. At least one of the top and bottom and left and right walls includes first and second substantially rigid frame members movable toward and away from each other during contraction and expansion of the bag. A rigid plate and one or more fasteners for mounting the plate on one of the first and second frame members are provided. The plate slidably overlies the other of the first and second frame members to provide a rigid framework for the bag when the bag is in the expanded position.

22 Claims, 4 Drawing Sheets

EXPANDABLE BAG WITH STIFFENING MEMBER

This invention pertains generally to expandable bags and, more particularly, to expandable framed fabric cases with stiffening members.

Expandable bags have heretofore been provided. For example, framed cases such as wheeled luggage have been provided with framed portions which expand outwardly from the main body after opening a zipper extending around the periphery of the bag. One of the difficulties encountered with such luggage is retaining the stiffness between the stationary framed portion and the movable framed portion when the bag is expanded. Efforts to provide rigidity to an expanded bag include strip members or plate members sewn into the bag between the stationary and movable framed portions. Unfortunately, bags incorporating such strip or plate members continue to sag during use. There is, therefore, a need for a new and improved expandable bag which overcomes these disadvantages.

In general, it is an object of the present invention to provide an expandable bag which is substantially rigid in both its collapsed and expanded positions.

Another object of the invention is to provide an expandable bag of the above character which can be easily made rigid when in its expanded position.

Another object of the invention is to provide an expandable bag of the above character in which a stiffening frame is provided in both the stationary portion and the expandable portion of the bag.

Another object of the inventions is to provide an expandable bag of the above character in which a stiffening member bridges between the stiffening frames of the stationary and expandable portions when the bag is in both its collapsed and expanded positions.

Another object of the invention is to provide an expandable bag of the above character in which the stiffening member is preferably rigidly mounted to one of the stiffening frames and, when the bag is in its expanded position, is removably fastened to the other stiffening frame.

Another object of the invention is to provide an expandable bag of the above character which can be wheeled or carried.

Additional objects and features of the invention will appear from the following description from which the preferred embodiments are set forth in detail in conjunction with the accompanying drawings.

Figure 2:
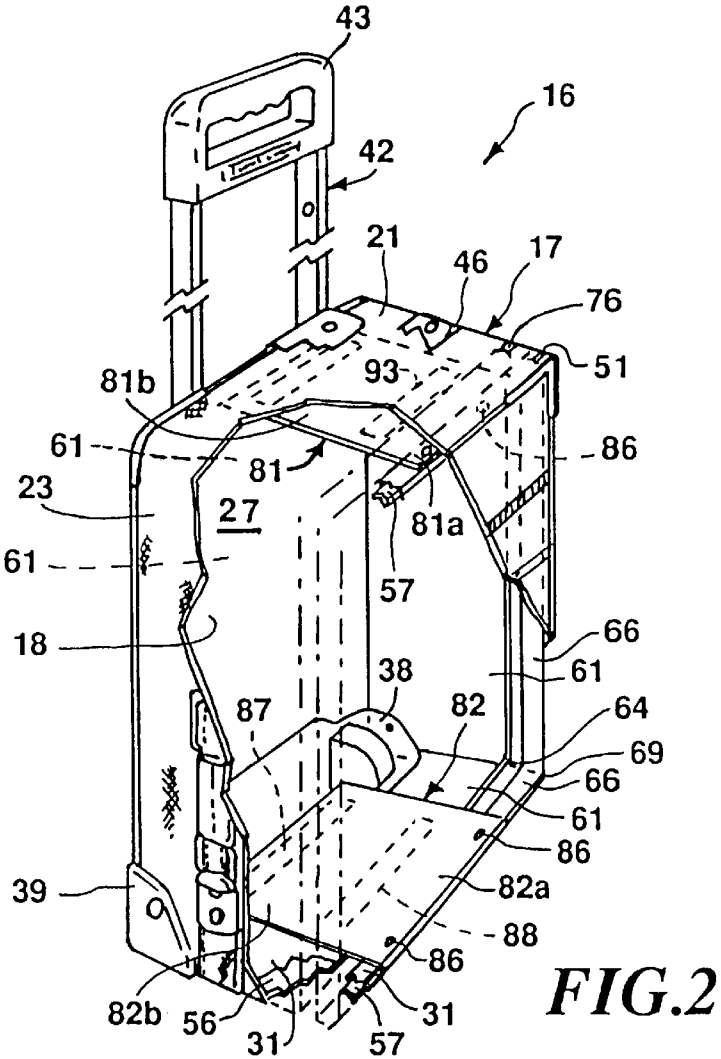
FIG. 2 is a perspective view, partially cut away, of the expandable bag of FIG. 1.

In general, an expandable bag movable between a contracted position and an expanded position is provided. The expandable bag comprises a body enclosing a space. The body has top and bottom walls, front and rear walls and left and right walls. Handle means is mounted on the body. At least one of the top and bottom and left and right walls includes first and second substantially rigid frame members movable toward and away from each other during contraction and expansion of the bag. A rigid plate and fastening means for mounting the plate on one of the first and second frame members are provided. The plate slidably overlies the other of the first and second frame members to provide a rigid framework for the bag when the bag is in the expanded position.

More in particular, expandable bag or upright suitcase 16 is a framed case suitable for carrying clothes and the like. Suitcase 16 has a body 17 having the shape of a right parallelepiped and is formed from six walls enclosing a space or main cavity 18. Specifically, body 17 has substantially rigid top and bottom walls 21 and 22 and substantially rigid left and right walls 23 and 24 (see FIGS. 1 and 8). Walls 21–24 form the outer periphery 26 of body 17. Body 17 further includes a soft rear wall 27 and a soft front wall in the form of door 28. The inner layer or lining 31 of each of the walls of body 17 is made from any suitable flexible web or woven material such as nylon (see FIG. 7). A flexible web means in the form of outer layer or cover 32 extends around body 17. Cover or skin 32 is made from any suitable durable material such as ballistic nylon.

Figure 1:
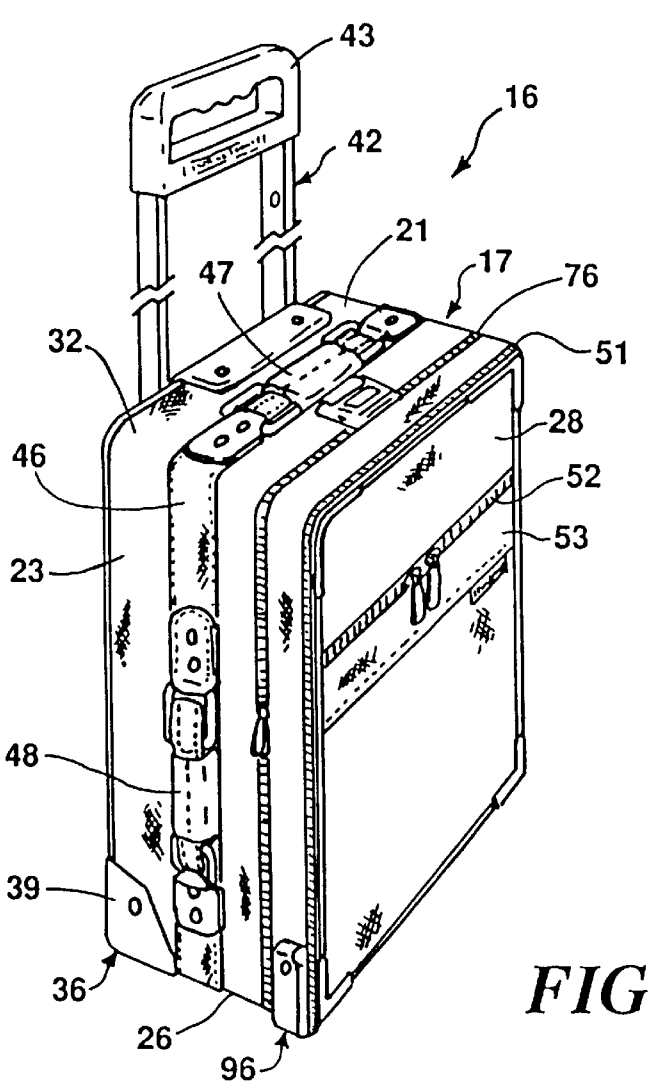
FIG. 1 is a perspective view of an expandable bag of the present invention prior to expansion.
Figure 4:
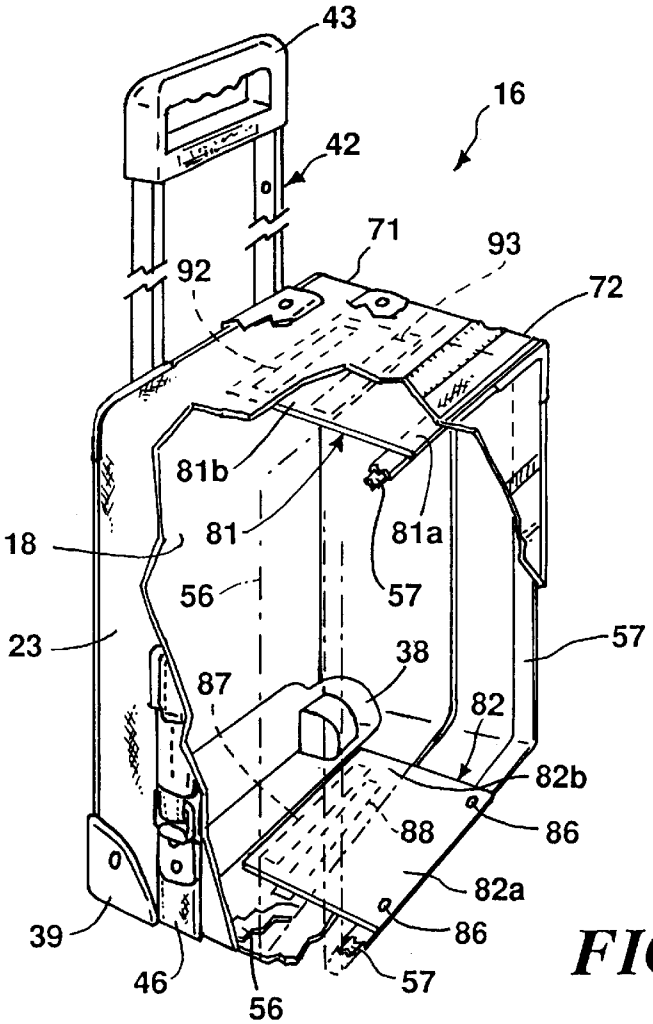
FIG. 4 is a perspective view, similar to FIG. 3 and partially cut away, of the expandable bag of FIG. 1 during the process of expansion.
Figure 8:
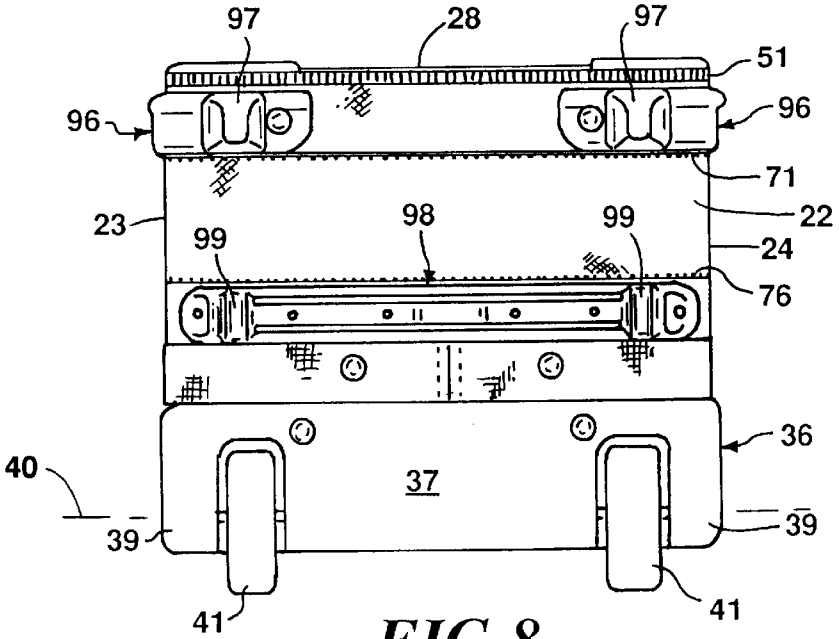
FIG. 8 is a bottom plan view of the expandable bag of FIG. 1 taken along the line 8—8 of FIG. 6.

A wheeled framework 36 is mounted on the rear of bottom wall 22 adjacent rear wall 27 (see FIGS. 1, 2 and 8). Framework 36 includes outer and inner pieces 37 and 38. The inner piece 38 is disposed in main cavity or compartment 18. Pieces 37 and 38 are each made from any suitable material such as plastic and are secured together by any suitable fastening means such as rivets (not shown). Outer piece 37 has first and second opposite end portions which serve as corner guards 39. First and second wheels 41 made from rubber or any other suitable material are included in framework 36 and are rotatably mounted in spaced apart positions along the rear lower edge of body 17 (see FIGS. 2 and 8). Wheeled framework 36 includes a handle assembly 42 which extends up the outside of rear wall 27. Handle assembly 42 has a handle means or handle 43 which is extendible upwardly from top wall 21 in a direction parallel to the plane of rear wall 27.

A strengthening strap 46 made from any suitable material such as nylon webbing, ballistic nylon or leather extends around and is secured to skin 32 on outer periphery 26 by any suitable means such as stitching (see FIG. 1). A first handle means or strap handle 47 is secured to strap 46 in the middle of top wall 21 to permit carrying of suitcase 16 in an upright position. A second handle means or strap handle 48 is secured to strengthening strap 46 in the middle of left wall 23 to permit carrying of suitcase 16 on its side.

A main zipper 51 extends around the edge of door 28 on top and bottom walls 21 and 22 and left wall 23 (see FIGS. 1 and 8). Door 28 pivots from right wall 24 to open and thus permit access to main cavity 18. A secondary zipper 52 extends across the outside of door 28 to permit access to a front pocket 53 provided in the door 28.

Figure 7:
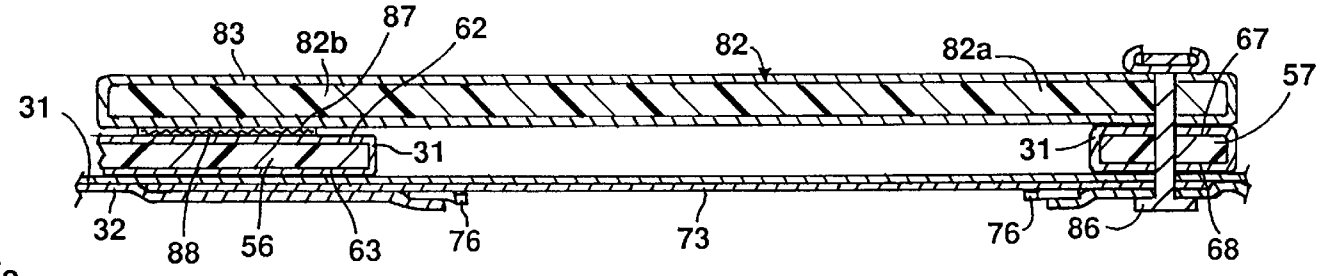
FIG. 7 is a cross-sectional view of the expandable bag of FIG. 1 taken along the line 7—7 of FIG. 6.

First and second substantially rigid frame members 56 and 57 provide the rigidity to top and bottom walls 21 and 22 and left and right walls 23 and 24 (see FIGS. 2 and 7). Frame members 56 and 57 each have the shape of an endless loop-like rectangular member and extend around outer perimeter 26 between inner lining 31 and outer skin 32. The frame members 56 and 57 are each made from any suitable substantially rigid material such as plastic and extend in respective first and second planes parallel to rear wall 27. The first frame member 56 includes four strip portions or strips 61 extending through the respective four walls of outer periphery 26 at right angles to each other. Strips 61 each have first or inner and second or outer spaced-apart planar surfaces 62 and 63, as shown in FIG. 7. The strips 61 are joined together at four rounded edges 64, as shown in FIG. 2. Similarly, second frame member 57 includes four strip portions or strips 66 having first or inner and second or outer spaced-apart surfaces 67 and 68. The strips 66 are joined together at four rounded edges 69. Strips 61 are significantly wider than strips 66 and serve as the rigid frame for main portion 71 of body 17 (see FIG. 5). Wheel framework 36 is mounted on first frame member 56 of main portion 71. The strengthening strap 46 and first and second strap handles 47 and 48 are each mounted on main portion 71.

Figure 6:
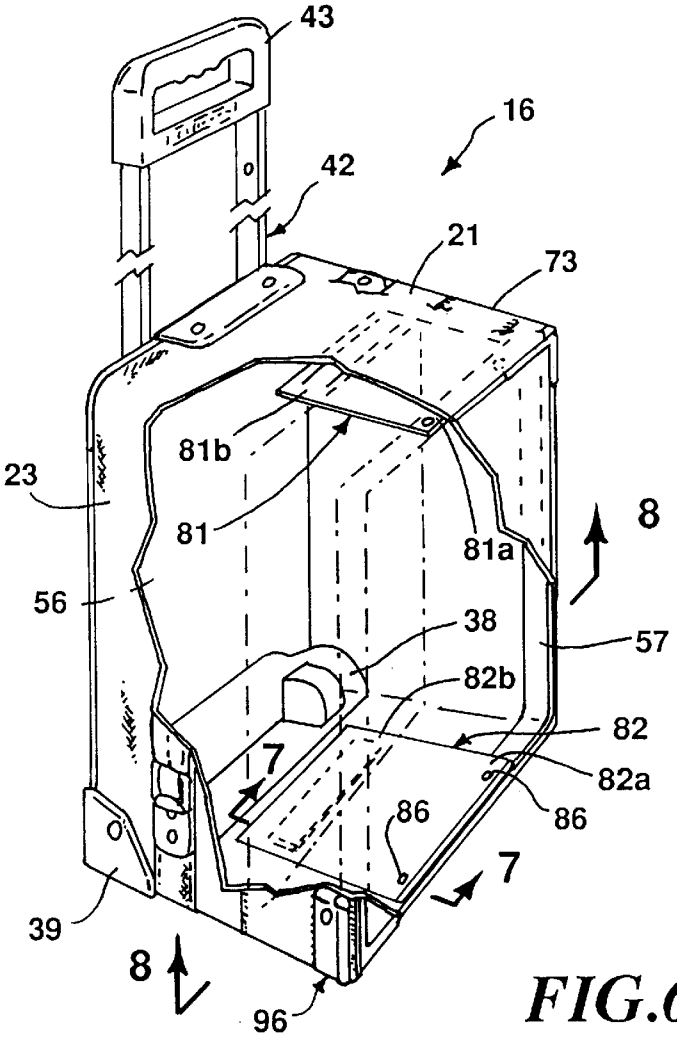
FIG. 6 is a perspective view, similar to FIG. 5 and partially cut away, of the expandable bag of FIG. 1 after expansion.
Figure 5:
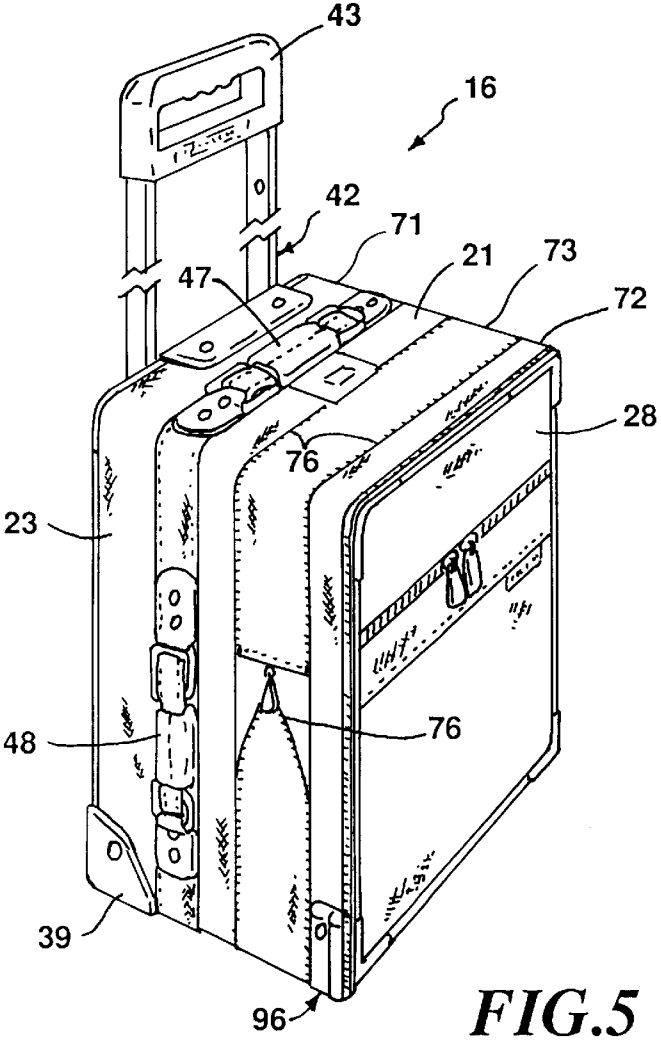
FIG. 5 is a perspective view of the expandable bag of FIG. 1 after expansion.

Second frame member 57 is included in the expandable portion 72 of body 17 (see FIG. 5). In this regard, second frame member 57 is movable toward and away from first frame member 56 in a direction perpendicular to the plane of the first and second frame members 56 and 57. Specifically, second frame member 57 is movable from a first position in close proximity to first frame member 56, shown in FIGS. 1 and 2, to a second position away from first frame member 57, shown in FIGS. 5 and 6. The outward movement of second frame members is limited by the flexible covering 32 at gusset or expansion panel 73. An exterior, expansion zipper 76 extends around outer periphery 26 at expansion panel 73. When expansion zipper 76 is in a closed position, as shown in FIG. 1, the material of expansion panel 73 is folded interior of the zipper 76. Opening of expansion zipper 76, as shown sequentially in FIGS. 3 and 5, permits expansion panel 73 to unfold so as to allow expandable portion 72 to be manually pulled away from main portion 71.

At least one rigid plate member is carried in at least one of the top and bottom and left and right walls 21–24 of suitcase 16 for inclusion in the stiffening means of suitcase 16 to rigidly secure expandable portion 72 to main portion 71 when the suitcase 16 is in its expanded position. Specifically, first and second rigid plate members or plates 81 and 82 are included within such stiffening means (see FIGS. 2 and 7). First or top plate 81 is carried interior top wall 21. Second or bottom plate 82 is carried interior bottom wall 22. The planar plates 81 and 82 are each made from any suitable rigid material such as plastic or wood and each have first and second spaced-apart planar surfaces. The plates can also be made from any suitable metal such as steel or aluminum. The plates have a width approximately equal to the width of walls 21 and 22 when suitcase 16 is in its contracted position and have a length less than the length of the walls 21 and 22. Plates 81 and 82 are each disposed within a covering 83 made from any suitable material such as the nylon material of inner lining 31.

Top and bottom plates 81 and 82 have respective first end portions 81*a* and 82*a* rigidly mounted to one of strips 61 or 66 of first and second frame members 56 and 57. Specifically, first end portion 82*a* of the bottom plate 82 is rigidly attached to strip 66 in bottom wall 22 flush with inner surface 67 so as to extend in a plane perpendicular to the plane of the frame members 56 and 57. Fastening means which includes first and second fasteners 86 extend through first end portion 82*a* and strip 66 to non-pivotly secure bottom plate 82 to second frame member 57 (see FIG. 7). Fasteners 86 can be of any suitable type such as conventional rivets or screws. The fasteners 86 are spaced apart on strip 66 and first end portion 82*a* to enhance the rigidity of the attachment. The flush mating of the planar surfaces of first end portion 82*a* and strip 66 inhibit pivotal movement between the plate 82 and second frame member 57. First end portion 81*a* of top plate 81 is similarly mounted to inner surface 67 of strip 66 in top wall 21 by means of additional fasteners 86. The top plate 81 extends from strip 66 in a plane perpendicular to the plane of second frame member 57.

Second end portion 82*b* of bottom plate 82 slidably overlies strip 61 of first frame member 56 in bottom wall 22 (see FIG. 2). Second end portion 81*b* of the top plate 81 similarly underlies strip 61 in top wall 21. Fastening means is carried by respective plates 81 and 82 and first frame member 56 for removably securing the plate 81 or 82 to the first frame member 56 when second frame member 57 is in its far away or expanded position shown in FIGS. 5 and 6. With respect to bottom plate 82, the fastening means is in the form of first and second cooperatively adhering fabric fastener or strip means or strips 87 and 88. First hook and loop fabric fastener or Velcro strip 87 is sewn or otherwise suitably secured to covering 83 on the underside of first end portion 82*a*. Second hook and loop fabric fastener or Velcro strip 88 is sewn or otherwise suitable secured to inner lining 31 on surface 62 of strip 61 adjacent the front edge of the first frame member 56. The Velcro strips 87 and 88 are positioned so as to be in registration with each other when second frame member 57 is moved to its expanded position. First and second fabric fastener or strip means or strips 92 and 93 are similarly provided for top plate 81. First hook and loop fabric fastener or Velcro strip 92 is mounted to cover 83 on the top side of first end portion 81*a*. Second hook and loop fabric fastener or Velcro strip 93 is secured to inner lining 31 on inner surface 63 of top wall 21. It should be appreciated that other fastening means can be provided for removably securing the plates 81 and 82 to first frame member 56 and be within the scope of the present invention. For example, flexible webbing and one or more fastex buckles could be utilized for such fastening means.

Suitcase 16 has additional supports which are utilized when the suitcase is placed in an upright position as shown in FIGS. 1–6. First and second edge pieces 96 of the type described in copending U.S. patent application Ser. No. 08/066,079 filed Apr. 24, 1998, the contents of which are incorporated herein by this reference, are mounted on the bottom edges of second frame member 57 (see FIG. 8). Edge pieces 96 are each made from any suitable material such as plastic and are each provided with a foot 97 which depends from bottom wall 22 of the suitcase. In addition, an elongate support member 98 made from plastic or any other suitable material is optionally mounted to outer surface 63 of strip 61 of first frame member 56. First and second spaced-apart feet 99 are formed integral with support member 98 and depend from bottom wall 22 between wheels 41 and edge pieces 96.

Figure 3:
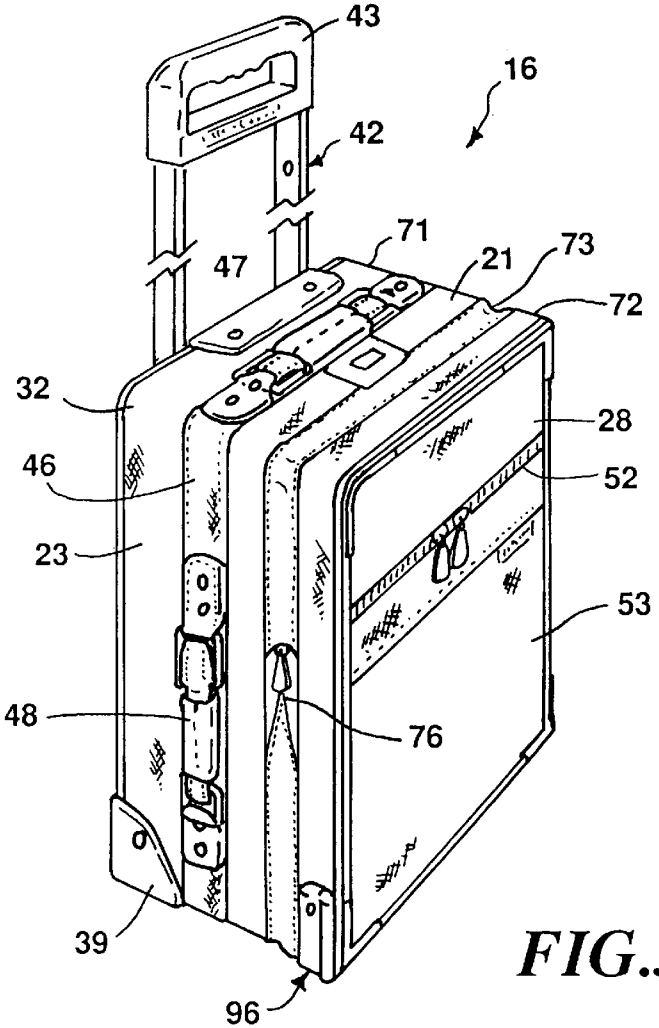
FIG. 3 is a perspective view of the expandable bag FIG. 1 during the process of expansion.

In operation and use, when it is desired to change suitcase 16 from its contracted position, shown in FIG. 1, to its expanded position, shown in FIG. 5, so as to expand the size of main cavity 18, expansion zipper 76 is opened from its closed position shown in FIG. 1 to its fully opened position shown in FIGS. 3 and 5. Second frame member 57 is grasped and manually moved from its first or home position shown in FIGS. 1 and 2 through its partially expanded position shown in FIGS. 3 and 4 to its second or fully expanded position shown in FIGS. 5 and 6. Although expandable portion 72 can be so moved outwardly from main portion 71 with door 28 closed, door 28 can be opened prior to such expansion of suitcase 16 to permit access to stiffening plates 81 and 82 during such expansion. Second end portions 81*b* and 82*b* of the plates 81 and 82 can be pivoted slightly toward the middle of main cavity 18 to facilitate registration of first Velcro strips 87 and 92 with second Velcro strips 88 and 93 (see FIG. 4). This slight pivoting of second end portions 81*b* and 82*b* about second frame member 57, which can range from zero to approximately 20°, is permitted by the minimal flexibility of the substantially rigid second frame member 57.

The gripping forces between the cooperatively adhering first and second Velcro strips 87 and 88 and first and second Velcro strips 92 and 93 provides a rigid framework for body 17 when suitcase 16 is in its expanded position. In this regard, top and bottom plates 81 and 82 serve as spaced-apart rigid links between first and second frame members 56 and 57. Second frame member 57 is thus inhibited from pivoting, slipping, drooping or sagging relative to first frame member 56 when main cavity 18 is full and suitcase 16 is being wheeled by handle 43 or carried by first strap handle 47 or second strap handle 48. The placement of plates 81 and 82 on opposite walls of body 17 enhances the stability of the rigid framework comprising first and second frame members 56 and 57 and top and bottom plates 81 and 82. The adhesion between first and second Velcro strips 87 and 88 and first and second Velcro strips 92 and 93 is enhanced when main cavity 18 is full because the suitcase contents tend to push outwardly against the plates 81 and 82 so as to press second Velcro strips 88 and 93 against the respective first Velcro strips 87 and 92. The relatively large surface area of plates 81 and 82 is advantageous in this regard. The relatively large engagement area between top and bottom plates 81 and 82 and respective inner surfaces 62 of first frame member 56 provides rigidity to body 17 when suitcase 16 is in its collapsed position.

Feet 97 on edge pieces 96 secured to second frame member 57 and feet 99 on support member 98 secured to first frame member 56 provide additional support when the suitcase 16 is placed in an upright position on the ground or another support surface as shown in FIGS. 1–6.

Although suitcase 16 has been shown with only first and second plates 81 and 82 rigidly secured to one of frame member 56 or 57, it should be appreciated that a suitcase having more or less than two of such stiffening members rigidly secured to one of frame members 56 and 57 can be provided and be within the scope of the present invention. For example, stiffening members similar to plates 81 and 82 can be provided in left and right walls 23 and 24, either in addition to or in substitution for plates 81 and 82 in top and/or bottom walls 21 and 22. Alternatively, a single plate or other stiffening member can be provided in only one of the walls of body 17. In another alternative embodiment, more than one stiffening member can be provided in one or more of the walls of body 17. For example, a plurality of separate plate or strip members having one end portion secured to second frame member 57 and the other one slidably overlying first frame member 56 can be provided in bottom wall 22. A plate or other stiffening member can also be rigidly secured to first frame member 56 and removably securable to second frame member 57. As can be seen, a variety of alternative embodiments can be provided within the scope of the present invention.

Figure 9:
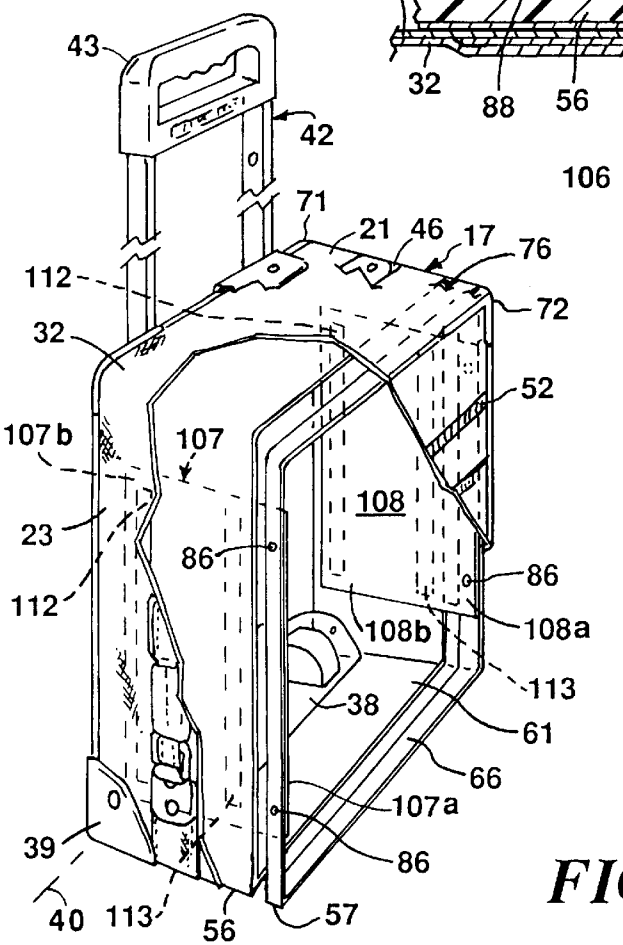
FIG. 9 is a perspective view, similar to FIG. 2, of another embodiment of the expandable bag of the present invention.

An example of another embodiment of the present invention is shown in FIG. 9. Expandable bag or upright suitcase 106 shown therein is substantially identical to suitcase 16 and like reference numerals have been used to describe the like components of suitcases 106 and 16. As shown in FIG. 9, suitcase 106 includes first and second frame members 56 and 57. Second frame member 57 is included in the expandable portion 72 of body 17 and is thus movable from a first position in close proximity to first frame member 56 to a second position away from the first frame member 57.

First and second rigid plate members or plates 107 and 108 are included within the stiffening means of suitcase 106 for rigidly securing expandable portion 72 to main portion 71 when suitcase 106 is in its expanded position. The first or left plate 107 is carried interior left wall 23 and second or right plate 108 is carried interior right wall 24. The planar plates 107 and 108 are substantially identical to plates 81 and 82 in composition and conformation. The plates have a width approximately equal to the width of walls 23 and 24 when suitcase 106 is in its contracted position and have a length less than the length of the walls 23 and 24. Plates 107 and 108 are each disposed within a covering 83.

Left and right plates 107 and 108 have respective first end portions 107*a* and 108*a* rigidly mounted to one of strips 61 or 66 of respective first and second frame members 56 and 57. Specifically, first end portion 107*a* of left plate 107 is rigidly attached to strip 66 of left wall 23 flush with inner surface 67 so as to extend in a plane perpendicular to the plane of the frame members 56 and 57. Fastening means which includes first and second fasteners 86 extend through first end portion 107*a* and strip 66 to non-pivotly secure left plate 107 to second frame member 57. Fasteners 86 are spaced apart on strip 66 and first end portion 107*a* to enhance the rigidity of the attachment. First end portion 108*a* of right plate 108 is similarly mounted to inner surface 67 of strip 66 in right wall 24 by means of additional fasteners 86. The right plate 108 extends from strip 66 in a plane perpendicular to the plane of second frame member 57.

Second end portion 107*b* of left plate 107 slidably overlies inner surface 62 of strip 61 of first frame member 56 in left wall 23. Second end portion 108*b* of right plate 108 similarly overlies inner surface 62 of strip 61 in right wall 24. Fastening means is carried by respective plates 107 and 108 and first frame member 56 for removably securing the plate 107 or 108 to the first frame member 56 when second frame member 57 is in its far away or expanded position. In this regard, two sets of first and second cooperatively adhering fabric fastener strip means or strips 112 and 113 substantially similar to first and second Velcro strips 87 and 88 are provided. The first Velcro strips 112 are each sewn or otherwise suitably secured to covering 83 on the inside of respective plate first end portions 107*a* and 108*a*. The second Velcro strips 113 are each sewn or otherwise suitably secured to inner lining 31 on surface 62 of strip 61 adjacent the front edge of the first frame member 56 in respective left and right walls 23 and 24. The first and second Velcro strips 112 and 113 of each set are positioned so as to be in registration with each other when second frame member 57 is moved to its expanded position.

In operation and use, suitcase 106 can be expanded in substantially the same manner as suitcase 16. Left and right plates 107 and 108 are pivoted in substantially the same manner as top and bottom plates 81 and 82 in suitcase 16 to facilitate registration and subsequent attachment of first and second Velcro strips 112 and 113 in each of the left and right walls 23 and 24. The gripping forces between the sets of first and second cooperatively adhering Velcro strips 112 and 113 provide a rigid framework for body 17 when suitcase 106 is in its expanded position. Left and right plates 107 and 108 are able to withstand substantial shear forces so as to inhibit pivoting, slipping, drooping or sagging of second frame member 57 relative to first frame member 56 when suitcase 106 is being wheeled by handle 43 or carried by first strap handle 47. The relatively rigid removable attachment of first Velcro strips 112 to respective second Velcro strips 113, enhanced when main cavity 18 is full and the contents therein serving to press left and right plates 107 and 108 outwardly against first frame member 56, inhibit the left and right plates 107 and 108 from rotating relative to second Velcro strips 113 and the first frame members 56 onto which strips 113 are attached.

As discussed above, additional plate members can be included in one or both of top and bottom walls 21 and 22 for further securing second frame member 57 to first frame member 56 when suitcase 106 is in its expanded position. For example, when one or more of plates 107 and 108 or similar plates are rigidly attached to one of the frame members 56 and 57 and removably attached to the other of the frame members, additional plate members can be provided in one or more of the other walls of suitcase body 17 for contributing to the rigidity of the expanded suitcase. These additional plate members can be attached to one or both of frame members 56 and 57 or attached to neither of the frame members 56 and 57 so as to be merely disposed in juxtaposition with the frame members 56 and 57. It should be further appreciated that if left and right plates 107 and 108 are required to only withstand shear forces, these plates need only be rigid in their respective planes and can be bendable from these planes. It should be further appreciated that the present invention is broad enough to cover any substantially rigid plate member or strip member which is disposed in juxtaposition with first and second frame members 56 and 57 when the suitcase is in its expanded position and is rigidly or otherwise mounted to one or both of the frame members 56 and 57 so as to provide a rigid link between the frame members 56 and 57 when the suitcase is so expanded.

The framed case of the present invention can be provided without wheeled framework 36 so as to be suitable only for carrying by a handle, shoulder strap or both. The framed case can also be other than in the shape of a right parallelepiped.

From the foregoing, it can be seen that an expandable bag which is substantially rigid in both its collapsed and expanded positions has been provided. The bag can be easily made rigid when in its expanded position. A stiffening frame is provided in both the stationary portion and the expandable portion of the bag. A stiffening member bridges between the stiffening frames when the bag is in both its collapsed and expanded positions. The stiffening member is preferably rigidly mounted to one of the stiffening frame and, when the bag is in its expanded position, is removably fastened to the other stiffening frame. The bag can be wheeled or carried.

I claim:

1. An expandable bag movable between a contracted position and an expanded position comprising a body enclosing a space, the body having top and bottom walls, front and rear walls and left and right walls, handle means mounted on the body, at least one of the top and bottom and left and right walls including first and second substantially rigid frame members movable toward and away from each other during contraction and expansion of the bag, a rigid plate having first and second end portions and first fastening means for securing the first end portion of the plate to the first frame member, the second end portion of the plate being separable from the second frame member for movement between a first position in juxtaposition with the second frame member when the bag is in the contracted position and a second spaced-apart position in juxtaposition with the second frame member when the bag is in the expanded position, and second fastening means for removably securing the second end portion of the plate to the second frame member when the plate is in the second position so that the plate provides a substantially rigid framework for the bag in the expanded position.

2. A bag as in claim 1 wherein the first fastening means includes first and second spaced-apart fasteners extending through the first end portion of the plate and the first frame member.

3. A bag as in claim 1 wherein the plate is made from a material selected from the group consisting of plastic, wood and metal.

4. A bag as in claim 1 wherein first and second rigid plates are provided, first fastening means for securing the first end portion of each of the first and second plates to the respective first frame member of the left and right walls, the second end portion of each of the first and second plates being separable from the respective second frame member for movement between a first position in juxtaposition with the second frame member when the bag is in the contracted position and a second spaced-apart position in juxtaposition with the second frame member when the bag is in the expanded position, and second fastening means for removably securing the second end portion of each of the first and second plates to the respective second frame member when the first and second plates are in the second position so that the first and second plates provide a substantially rigid framework for the bag in the expanded position.

5. A bag as in claim 1 wherein the first and second frame members each extend around the space.

6. A bag as in claim 5 wherein the first and second frame members extend in respective, parallel first and second planes.

7. A bag as in claim 5 wherein each of the first and second frame members is a closed rectangular member.

8. A bag as in claim 1 including additional fastening means for removably securing the second end portion of the plate to the second frame member when the plate is in the first position.

9. A bag as in claim 1 wherein the second fastening means includes first and second cooperatively-engaging fabric fastener strips respectively carried by the plate and the second frame member.

10. An expandable bag movable between a contracted position and an expanded position comprising a body enclosing a space, the body being in the shape of a parallelepiped and having top and bottom walls, front and rear walls and left and right walls, a wheeled framework and a handle mounted on the body, at least one of the top and bottom and left and right walls including first and second substantially rigid frame members movable toward and away from each other during contraction and expansion of the bag, a rigid plate having first and second end portions, first fastening means for securing the first end portion of the plate to the first frame member to permit the second end portion of the plate to pivot into the space and thus permit the second end portion of the plate to move between a first position in juxtaposition with the second frame member when the bag is in the contracted position and a second spaced-apart position in juxtaposition with the second frame member when the bag is in the expanded position, second fastening means for removably securing the second end portion of the plate to the second frame member to provide a substantially rigid framework when the bag is in the expanded position.

11. A bag as in claim 10 wherein the first fastening means includes means for riveting the first end portion of the plate to the first frame member.

12. A bag as in claim 10 wherein the wheeled framework is mounted on one of the first and second frame members.

13. A bag as in claim 10 wherein the second fastening means includes a cooperatively-engaging hook and loop fabric fastener.

14. An expandable framed case comprising a body having an outer periphery defining a main cavity, the body having first and second substantially rigid frame members extending around the outer periphery, the first frame member extending in a first plane and the second frame member extending in a second plane parallel to the first plane, the second frame member being movable in a direction perpendicular to the planes from a first position in close proximity to the first frame member to a second position away from the first frame member, the body having a flexible web material extending around the periphery between the first and second frame members and permitting the second frame member to move between its first and second positions relative to the first frame member, at least one substantially rigid plate member extending along a portion of the outer periphery between the first and second frame members and having first and second end portions, at least two spaced-apart fasteners extending through the first end portion of the plate member and one of the frame members for rigidly securing the plate member to said frame member, the second end portion of the plate member being separable from the other of the frame members for movement between a first position in juxtaposition with the other frame member when the bag is in the contracted position and a second spaced-apart position in juxtaposition with the other frame member when the bag is in the expanded position, and fastening means for removably securing the second end portion of the plate member to the other of the frame members when the second frame member is in its second position whereby the plate member inhibits movement of the second frame member in the second plane when the second frame member is in its second position.

15. A case as in claim 14 wherein the at least two spaced-apart fasteners include at least two spaced-apart fasteners extending through the first end portion of the plate member and the first frame member.

16. A case as in claim 15 wherein the fastening means includes a first fabric fastener strip mounted on the second end portion of the plate member and a second fabric fastener strip mounted on the second frame member.

17. A case as in claim 16 wherein the plate member extends in a third plane perpendicular to the first and second planes so as to slidably engage the second frame member.

18. An expandable framed case comprising a body having an outer periphery defining a main cavity, the body having first and second substantially rigid frame members extending around the outer periphery, the first frame member extending in a first plane and the second frame member extending in a second plane parallel to the first plane, the second frame member being movable in a direction perpendicular to the planes from a first position in close proximity to the first frame member to a second position away from the first frame member, the body having a flexible web material extending around the periphery between the first and second frame members and permitting the second frame member to move between its first and second positions relative to the first frame member, at least one substantially rigid plate member extending along a portion of the outer periphery between the first and second frame members and having first and second end portions, first fastening means for securing the first end portion of the plate member to one of the frame members, the second end portion of the plate member being separable from the other of the frame members for movement between a first position in juxtaposition with the other frame member when the bag is in the contracted position and a second spaced-apart position in juxtaposition with the other frame member when the bag is in the expanded position, and second fastening means for removably securing the second end portion of the plate member to the other of the frame members when the second frame member is in its second position whereby the plate member inhibits movement of the second frame member in the second plane when the second frame member is in its second position.

19. A case as in claim 18 wherein the second fastening means includes a first fabric fastener strip mounted on the second end portion of the plate member and a second fabric fastener strip mounted on the second frame member.

20. A case as in claim 19 wherein the plate member extends in a third plane perpendicular to the first and second planes so as to slidably engage the second frame member.

21. A case as in claim 18 further comprising a wheeled framework mounted on the body and having first and second wheels rotatable about an axis of rotation.

22. A case as in claim 21 wherein the at least one substantially rigid plate member extends perpendicularly of the axis of rotation.

* * * * *